US006327455B1

(12) United States Patent
Hamilton et al.

(10) Patent No.: US 6,327,455 B1
(45) **Date of Patent: *Dec. 4, 2001**

(54) BACK-UP ROLLER WITH REDUCED MASS

(75) Inventors: Douglas Campbell Hamilton, Lexington; Ann Marie Garland, Nicholasville, both of KY (US)

(73) Assignee: Lexmark International, Inc., Lexington, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/491,278

(22) Filed: Jan. 26, 2000

(51) Int. Cl.[7] ..... G03G 15/20
(52) U.S. Cl. ..... 399/331; 399/333
(58) Field of Search ..... 399/331, 320, 399/328, 330, 332, 333; 219/469, 470, 471, 216; 430/97, 99

(56) References Cited

U.S. PATENT DOCUMENTS

| | | | | |
|---|---|---|---|---|
| 4,348,579 | | 9/1982 | Namba | 219/216 |
| 4,645,327 | | 2/1987 | Kimura et al. | 355/3 R |
| 4,822,978 | | 4/1989 | Morris et al. | 219/216 |
| 4,942,434 | * | 7/1990 | Nakai et al. | 399/331 |
| 5,023,464 | * | 6/1991 | Mitsuya et al. | 399/330 X |
| 5,091,752 | | 2/1992 | Okada | 355/285 |
| 5,223,902 | | 6/1993 | Chodak et al. | 355/290 |
| 5,307,133 | | 4/1994 | Koshimizu et al. | 355/385 |
| 5,659,866 | | 8/1997 | Kim | 399/330 |
| 5,722,026 | | 2/1998 | Goto et al. | 399/333 |
| 5,724,638 | * | 3/1998 | Isogai et al. | 399/333 |
| 5,839,042 | * | 11/1998 | Tomatsu | 399/320 |

FOREIGN PATENT DOCUMENTS 2-212027 * 8/1990 (JP) .

OTHER PUBLICATIONS

U.S. application No. 09/491,610, Burdick, et al. (Belt Fuser Wiper, concurrently filed Jan. 26, 2000).

* cited by examiner

*Primary Examiner*—Sophia S. Chen
*Assistant Examiner*—Hoan Tran
(74) *Attorney, Agent, or Firm*—John A. Brady

(57) ABSTRACT

A back-up roller (51) for use in the fusing portion of an electrophotographic process is disclosed. This back-up roller has an inner cylindrical metal core (71), an outer hollow cylindrical metal shell (72) surrounding the core, and a plurality of metal ribs (73) running lengthwise between and attached to the core and the shell. The outer surface of the shell is coated with a layer (74) of a rubberized material. This back-up roller, when used in the fuser portion of an electrophotographic process, reducing the condensation of moisture on its surface, thereby effectively eliminating fuser stalls.

15 Claims, 3 Drawing Sheets

BACK-UP ROLLER WITH REDUCED MASS

TECHNICAL FIELD

This invention relates to electrophotographic processes and, particularly, the prevention of stalling and paper jams by minimizing the accumulation of moisture in the fuser portion of the electrophotographic device.

BACKGROUND OF THE INVENTION

In electrophotography, a latent image is created on the surface of an insulating, photoconducting material by selectively exposing an area of the surface to light. A difference in electrostatic charge density is created between the areas on the surface exposed and those unexposed to the light. The latent electrostatic image is developed into a visible image by electrostatic toners, containing pigment components and thermoplastic components. The toners, which may be liquids or powders, are selectively attracted to the photoconductor's surface, either exposed or unexposed to light, depending upon the relative electrostatic charges on the photoconductor's surface, development electrode, and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor's surface, pulling the toner from the photoconductor's surface onto the paper or intermediate medium still in the pattern of the image developed from the photoconductor's surface. A set of fuser rollers or belts, under heat, melts and fixes the toner in the paper, subsequent to transfer, producing the printed image.

The electrostatic printing process, therefore, comprises an intricate and ongoing series of steps in which the photoconductor's surface is charged and discharged as the printing takes place. In addition, during the process, various charges are formed on the photoconductor's surface, the toner and the paper surface to enable the printing process to take place. Having the appropriate charges in the appropriate places at the appropriate times is critical to making the process work.

After the image is transferred to the paper or other recording medium, it goes to the fuser where the paper is moved through a nip where it is heated and pressed. This melts the thermoplastic portion of the toner, causing it to bond with the fibers of the paper, thereby fixing the image onto the paper or recording medium. While this is an effective way of fixing the toner image on the paper's surface, it carries with it some problems. Specifically, various types of copy media, such as bond paper and tracing paper, contain significant amounts of moisture. During the passage of this paper through the fusing area, the moisture is heated and evaporates. The steam vapor then escapes into other portions of the printer creating the potential for rust and corrosion, which can inhibit machine performance and useful life. The steam can also condense and form puddles in entrapment areas, such as on the surface of the back-up or pressure roller in the fuser. When it does so, it is carried around to the fuser nip, reducing the coefficient of friction between the back-up roller, the paper and the fuser belt. Since in a desktop printer, the back-up roller, through friction, rotates the fuser belt, this reduction in the coefficient of friction causes the paper to slip. This slippage delays the arrival of the paper at the exit sensor, registering as a paper-feed failure, causing the machine to stop. In another scenario, the slippage of the belt, caused by moisture in the fuser area, causes the paper to not enter the fuse nip thereby producing a fuser jam. In both cases, the printer ceases operation, requiring that the operator clear and restart it, delaying completion of the printing project underway.

The problems caused by moisture are particularly acute where the printer utilizes a fuser belt, rather than a fuser roll, especially one that is not self-driven, but rather is driven by friction between the belt, the paper and the back-up roller (which is driven). In this commonly used apparatus, when moisture condenses on the back-up roller, it wets the fuser nip and the fuser belt. This can result in slippage of the paper which delays arrival of the paper at the exit sensor, causing the printer to stop. This requires the operator to clear the paper path and restart the printer to complete the print job. Another problem caused by the presence of moisture is the result of back-up roller/fuser belt slippage. Such slippage can cause a paper bubble, as the paper enters the fuser nip, which not only can result in a paper jam, but can also cause the paper to rub against fuser surfaces, smearing the unfixed toner. These problems are collectively referred to herein as "fuser stalls."

It is clear, for several reasons, that effective removal of moisture, created by the fusing process, from the back-up roller in the belt fuser is very important. The present development describes an effective way to accomplish this goal. Although the prior art recognizes that the production of moisture by the fusing process is undesirable, there are few methods suggested for combating this problem and those methods which have been suggested have significant drawbacks.

U.S. Pat. No. 5,722,026, Goto, et al., issued Feb. 24, 1998, describes a back-up roller which incorporates an elastic layer and a surface layer (fluororesin plus high-friction resin) on an iron or aluminum mandrel. This disclosure does not address in any way the issue of water condensation caused by the fuser in the electrostatic printing process. This patent suggests, at column 1, lines 65–67, that there is a relationship between decreased back-up roller diameter and increased thermal efficiency of the fuser system.

U.S. Pat. No. 4,348,579, Namba, issued Sep. 7, 1982, describes a fuser roller with ribs and reinforcing inserts, which allows the roller to have thin walls for efficient heat transfer, while still providing sufficient strength to withstand the pressure applied in the fusing nip. This patent does not deal with the structure of the back-up roller or with the problem of moisture accumulation caused by the fusing process.

U.S. Pat. No. 5,223,902, Chodak, et al., issued Jun. 29, 1993, describes a moisture collection and removal system for a fuser. The fuser involved does not use a back-up or pressure roller, but rather forms a fusing nip between the fuser roller and a pad biased against the fuser roller. In this system, moisture condenses and falls by gravity into a collection area.

U.S. Pat. No. 4,822,978, Morris, et al., issued Apr. 18, 1989, describes a fuser apparatus which utilizes a low mass fuser roller and a flexible web to keep sheets of paper in biased contact with the fuser roller. The web contains perforations which allow accumulated moisture to escape from the fuser system, the moisture can then be wiped from the outer surface of the web. There is no back-up roller utilized in this system and no structure is given for the wiping mechanism.

U.S. Pat. No. 4,645,327, Kimura, issued Feb. 24, 1987, describes an electrophotographic apparatus which prevents condensation of moisture on the photoconductor's surface. This patent also describes (see column 10, lines 31 et. seq.)

a wiper comprised of an aluminum shaft having layers of felt and/or urethane sponge to wipe moisture off the photoreceptor drum. Such structures are generally not effective in dealing with the moisture problem since they tend to absorb water, become saturated, and then feed water back onto the surface of the drum.

U.S. Pat. No. 5,307,133, Koshimizu, et al., issued Apr. 26, 1994, addresses the problem of moisture condensation on the fuser apparatus by incorporating a fan into the printer to eliminate water vapor in the air. This is an indirect way of dealing with addressing the problem which is not as effective as directly addressing the issue by preventing moisture accumulation on the back-up roller.

U.S. Pat. No. 5,091,752, Okada, issued Feb. 25, 1992, addresses the moisture condensation issue by incorporating a heat-insulating surface layer on the back-up roller.

Concurrently-filed U.S. patent application Ser. No. 09/491,610, Belt Fuser Wiper, Burdick, et al., describes the use of a high surface energy material to wipe and remove moisture which condenses on the surface of the back-up roller in the fusing system.

It has now been found that moisture accumulation on the back-up roller can be reduced by utilizing a back-up roller having reduced thermal mass, particularly a roller which comprises an inner cylindrical metal core and an outer hollow cylindrical metal shell surrounding the core, and having a plurality of metal ribs running lengthwise between the core and the shell. The void spaces in this roller reduce the thermal mass of the roller, allowing it to more quickly achieve a temperature comparable to that of the fuser belt, thereby reducing the amount of moisture which condenses on its surface. Such a roller is preferably made by extrusion. This approach effectively reduces the formation of moisture on the back-up roller, thereby eliminating fuser stalls and corrosion of parts; it achieves these ends effectively, inexpensively, and in a manner suited for the small spaces available in a desktop printer context.

SUMMARY OF THE INVENTION

The present invention encompasses a back-up roller for use in the fusing portion of an image-forming device, comprising an inner cylindrical metal core, an outer hollow cylindrical metal shell surrounding and concentric with said core, and a plurality of metal ribs running lengthwise between and attached to said core and said shell, wherein the outer surface of said shell carries a layer of a rubberized material having a thickness of no greater than about 5 mm. Preferred back-up rollers are formed in one piece by extrusion, preferably from aluminum.

The present invention also emcompasses an image-fixing device comprising:

a first moveable heated fixing member and a second rotatable back-up member, as described above, forming a nip therebetween which transport a recording material through said nip thereby fixing toner to create an image on said recording material; and means for driving at least one of the first and second members.

DETAILED DESCRIPTION OF THE INVENTION

The present invention relates to the use of a back-up roller having a reduced thermal mass in the fuser portion of an electrophographic process or device. By using this reduced mass back-up roller, the temperature of the surface of the back-up roller more quickly approaches that of the fuser belt when the device is started. This reduces condensed moisture on the surface of the back-up roller, eliminating fuser stalls in a very simple and cost-effective manner, without requiring major restructuring of the printer design.

Figure 1:
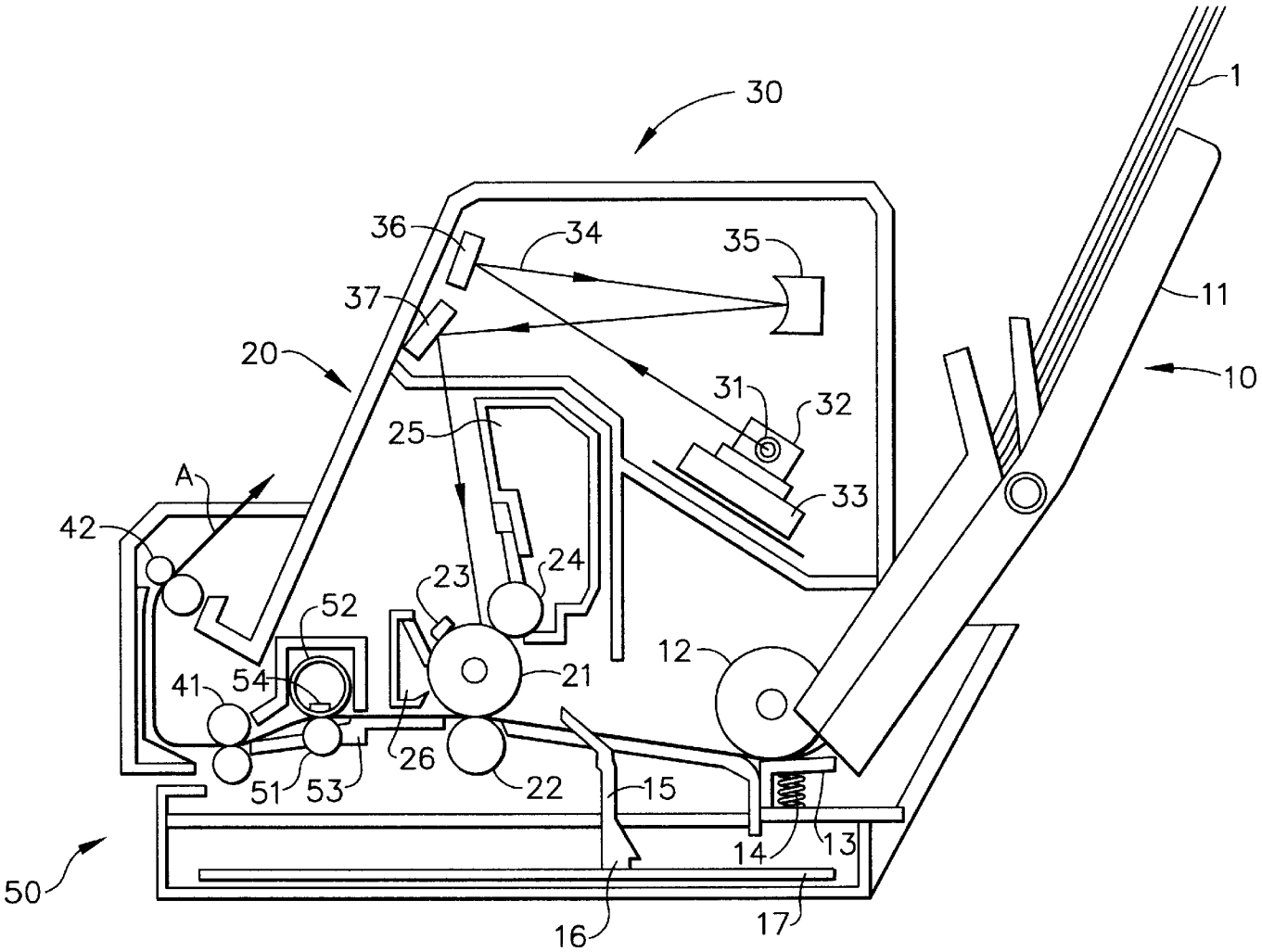
FIG. 1 is a schematic view of a laser printer representing a typical electrophotographic apparatus, particularly one used in a desktop printer or copier.

A standard design for a laser printer, a representative electrophographic device, is shown in FIG. 1. It includes a paper feed section (10), an image-forming device (20), a laser scanning section (30), and a fixing device (50). The paper feed section (10), sequentially transports sheets of recording paper (1) to the image-forming device (20) provided in the printer. The image-forming device (20) transfers a toner image to the transported sheet of recording paper (1). The fixing device (50) fixes toner to the sheet of recording paper (1) sent from the image-forming device (20). Thereafter, the sheet of recording paper (1) is ejected out of the printer by paper transport rollers (41, 42). In short, the sheet of recording paper (1) moves along the path denoted by the arrow (A) in FIG. 1.

The paper feed section (10) includes a paper feed tray (11), a paper feed roller (12), a paper separating friction plate (13), a pressure spring (14), a paper detection actuator (15), a paper detection sensor (16), and a control circuit (17).

Upon receiving a print instruction, the sheets of recording paper (1) placed in the paper feed tray (11) are fed one by one into the printer by operation of the printer feed roller (12), the paper separating friction plate (13) and the pressure spring (14). As the led sheet of recording paper (1) pushes down the paper detection actuator (15), the paper detection sensor (16) outputs an electrical signal instructing commencement of printing of the image. The control circuit (17), started by operation of the paper detection actuator (15), transmits an image signal to a laser diode light-emitting unit (31) of the laser scanning section (30) so as to control on/off of the light-emitting diode.

The laser scanning section (30) includes the laser diode light-emitting unit (31), a scanning mirror (32), a scanning mirror motor (33), and reflecting mirrors (35, 36, and 37).

The scanning mirror (32) is rotated at a constant high speed by the scanning mirror motor (33). In other words, laser light (34) scans in a vertical direction to the paper surface of FIG. 1. The laser light (34) radiated by the laser diode light emitting unit (31) is reflected by the reflecting mirrors (35, 36, and 37) so as to be applied to the photosensitive body (21). When the laser light (34) is applied to the photosensitive body (21), the photosensitive body (21) is selectively exposed to the laser light (34) in accordance with on/off information from this control circuit (17).

The image-forming device (20) includes the photosensitive body (21), a transfer roller (22), a charging member (23), a developing roller (24), a developing unit (25), and a cleaning unit (26). The surface charge of the photosensitive body (21), charged in advance by the charging member (23) is selectively discharged by the laser light (34). An electrostatic latent image is thus formed on the surface of the photosensitive body (21). The electrostatic latent image is visualized by the developing roller (24) and the developing unit (25). Specifically, the toner supplied from the developing unit (25) is adhered to the electrostatic latent image on the photosensitive body (21) by the developing roller (24) so as to form the toner image.

Toner used for development is stored in the developing unit (25). The toner contains coloring components (such as carbon black for black toner) and thermoplastic components. The toner, charged by being appropriately stirred in the developing unit (25), adheres to the above-mentioned electrostatic latent image by an interaction of the developing bias voltage applied to the developing roller (24) and an electric field generated by the surface potential of the photosensitive body (21), and thus conforms to the latent image, forming a visual image on the photosensitive body (21). The toner typically has a negative charge when it is applied to the latent image forming the visual image.

Next, the sheet of recording paper (1) transported from the paper feed section (10) is transported downstream while being pinched by the photosensitive body (21) and the transfer roller (22). The paper (1) arrives at the transfer nip in timed coordination with the toned image on the photosensitive body (21). As the sheet of recording paper (1) is transported downstream, the toner image formed on the photosensitive body (21) is electrically attracted and transferred to the sheet of recording paper (1) by an interaction with the electrostatic field generated by the transfer voltage applied to the transfer roller (22). Any toner that still remains on the photosensitive body (21), not having been transferred to the sheet of recording paper (1), is collected by the cleaning unit (26). Thereafter, the sheet of recording paper (1) is transported to the fixing device (50). In the fixing device (50), an appropriate temperature and pressure are applied while the sheet of recording paper (1) is being pinched by moving through the nip formed by a pressure (or a pickup) roller (51) and the fixing roller (52) (or belt) that is maintained at a constant temperature. The thermoplastic components of the toner are melted by the back-up roller (52) and fixed to the sheet of recording paper (1) to form a stable image. The sheet of recording paper (1) is then transported and ejected out of the printer by the printer transport rollers (41, 42).

Next, the operation of the fixing device (50) will be described in the detail.

The fixing device (50) includes the back-up (or pressure) roller (51) and the fixing roller (or, in some embodiments, a fixing belt) (52). The present invention may be used either with a fixing roller or a fixing belt. In the context of a fixing/fuser roller, the low thermal mass back-up roller of the present invention is advantageous if the conventional back-up roller is so massive that it takes a long time to heat up to fuser temperature, thereby slowing down printer start-up. In that context, the reduced mass back-up roller heats up much more quickly and presents a real advantage. The reduced mass back-up roller however is particularly useful in the context of a fuser belt. Both embodiments will be discussed.

The fixing roller (52) is generally composed of a hollow cylinder made from a material which conducts heat, such as aluminum, and the outer surface of which is coated with a synthetic resin material having good toner release, paper transport and heat resistance properties. An example of this coating is the synthetic resin material fluororesin for its toner release properties, used together with the heat resistant rubber, such as a silicone rubber, for its good paper transport properties. These materials are mixed, applied to the surface of the roller, and then baked. The roller is made from a material which conducts heat and which has sufficient structural integrity such that it maintains its shape when it is used against a back-up roller (51) to form a nip through which the printed pages travel. Typically the pressure between the fuser roller (52) and the back-up roller (51) for desktop laser printers is from about 5 to about 30 psi. The fuser roller (52) is generally made from materials having a high thermal conductivity and a relatively high thermal capacity. Preferred materials are those selected from aluminum, copper, steel, and mixtures of those materials. The most preferred material is aluminum, because of its excellent thermal properties and its relatively low cost. A heater lamp is placed within the hollow portion of the fuser roller (52). The heater lamp serves as the means by which the fuser roller (52) is heated during use.

In an embodiment in which a fixing belt is used, rather than a fixing roller, the belt is generally an endless belt or tube formed from a highly heat resistive and durable material having good parting properties and a thickness of not more than about 100 $\mu$m, preferably not more than about 70 $\mu$m. Preferred belts are made from a polyimide film. The belt may have an outer coating of, for example, a fluororesin or Teflon material, to optimize the release properties of the fixed toner from the belt. Such fuser belts are well-known in the art. A heater (54), generally a ceramic heater, is placed on the inside surface of the belt and the outside surface of the belt forms a fusing nip with the back-up roller (51) at the point of the heater. Each page carrying the toner travels through this nip and the toner is fixed on the page through the combination of applied heat, the time the page is in the nip, and pressure. Typically, the pressure between the fuser belt (52) and the back-up roller (51) at the fuser nip is from about 5 to about 30 psi in desktop laser printers. Although the fuser belt (52) may be driven itself, typically that is not the case. Generally, the back-up roller (51) is rotated and it is the friction between the surface of the back-up roller (51) and the printed page, and ultimately the surface of the fuser belt (52), which causes the fuser belt (52) to rotate. This is why maintaining the appropriate coefficient of friction in the fuser nip is so important and why the presence of moisture in the nip can cause fuser stalling.

Figure 2:
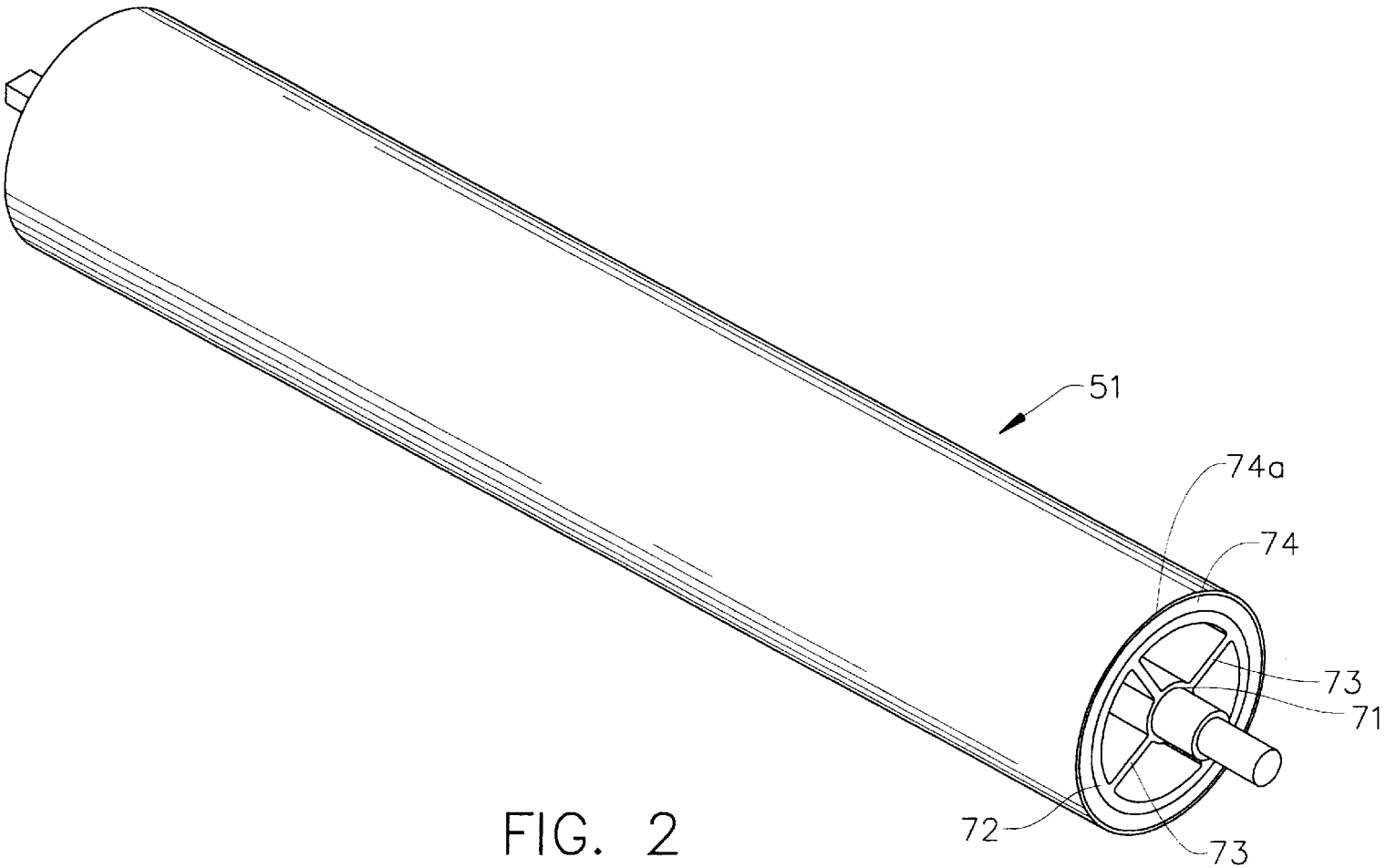
FIG. 2 is an isometric view of the reduced mass back-up roller of the present invention.
Figure 3:
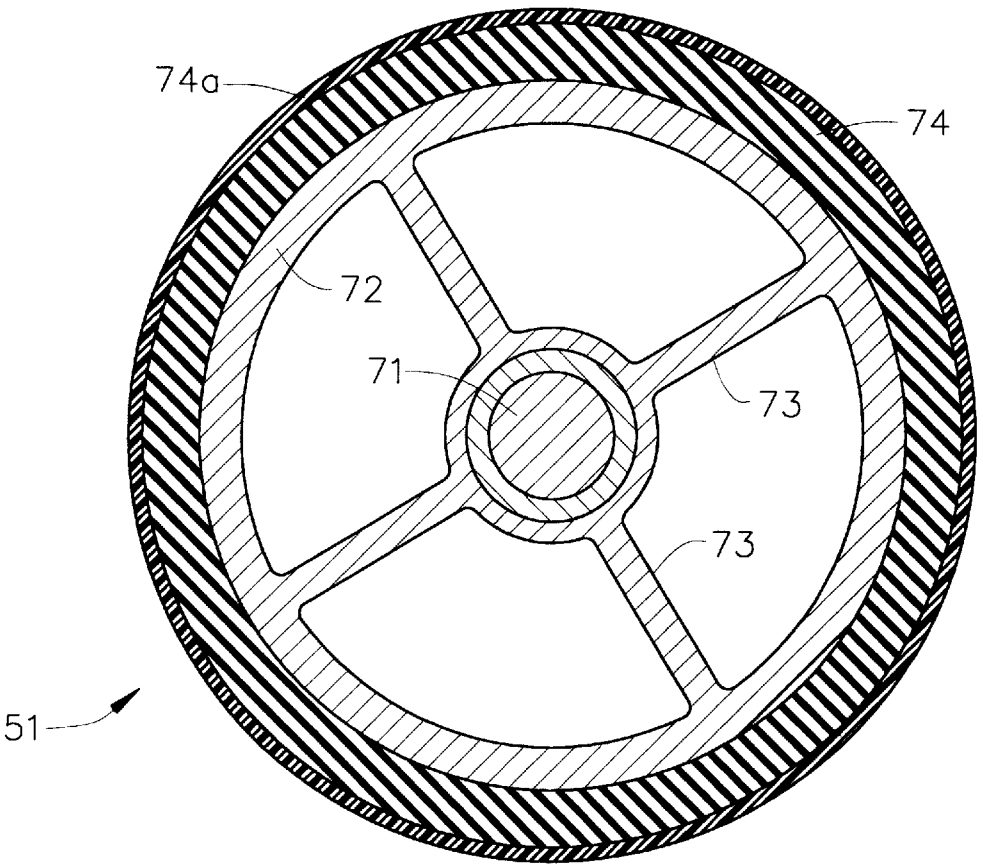
FIG. 3 is a cross-sectional view of the reduced mass back-up roller illustrated in FIG. 2.

The back-up roller (51) is a key element of the present invention. A preferred embodiment of the back-up roller is shown in FIG. 2 of the present application and a cross-sectional view of that roller is shown in FIG. 3. The back-up roller (51) is generally cylindrical in shape and it comprises an inner cylindrical metal core (71), an outer hollow cylindrical metal shell (72) surrounding the length of the core, and a plurality of metal ribs (73) running lengthwise between the core and the shell. Taken in cross-sections, the core and the metal shell will generally be concentric. The core (71) is typically solid (although it can be hollow) and can include projections which extend outward from the ends of the roller (as shown in FIG. 2), to allow the roller to be held in place in the fuser mechanism. The ribs are attached to both the core and the shell and provide strength and stability to the structure. The structure generally contains two or more ribs and, preferably, the ribs are spaced equally around the core (i.e., the angles between ribs are approximately equal). Preferred structures contain three or four ribs, with the most preferred structure (e.g., the one illustrated in FIGS. 2 and 3) utilizing four ribs (i.e., the ribs are approximately perpendicular to one another). The ribs preferably run the entire length of the roller (such a structure is easiest to extrude). However, the ribs may run only a portion of the roller length, as long as there are other ribs spanning the remaining portions of the length to provide the roller with the required ability to withstand nip pressure.

The back-up roller (51) is generally from about 21 to about 30 cm in length, preferably from about 22 to about 23 cm. The diameter of the back-up roller (51) is generally from about 15 to about 50 mm, with preferred rollers having diameters from about 20 to about 38 mm.

In a preferred embodiment, the ribs (73), inner core (71) and outer shell (72) of the back-up roller (51) are all made from the same metal. The metal generally utilized for making the back-up rollers are those which have a relatively high thermal conductivity and, preferably, are relatively inexpensive. Examples of metals which can be used for making the back-up roller include aluminum, copper, steel, and mixtures thereof. The most preferred material is aluminum, because of its excellent thermal properties and its relatively low cost. In a preferred aspect of the present invention, the metal portions of the back-up roller are formed in one piece by an extrusion process. The shape described in the present application is particularly applicable for manufacture by extrusion. This process provides a relatively easy and inexpensive method for making the back-up rollers. The extrusion process is well-known in the art. In this process, a rectangularly-shaped ingot is pushed through a die which forms the shape of the desired extrusion product.

The core (71), outer shell (72), and ribs (73) of the back-up roller (51) can be fabricated from different materials if specific thermal properties for the roller are desired. However, to do that, would require separate fabrication of the core, ribs and outer shell, resulting in a much more time-consuming and costly process. Utilizing a single material for the entire back-up roller and, particularly, forming it by an extrusion process, is an exceptionally cost-effective way of forming the back-up roller.

The back-up roller (51) of the present invention is coated with a material referred to herein as a "rubberized material" (74), which has good release and transport properties for the recording paper (1). This coating (74) should be sufficiently soft so as to allow it to be rotated against the fuser roller or belt (52) to form a nip through which the printed pages travel. By going through this nip, printed pages are placed under pressure and the combined effects of this pressure, the time the page is in the nip, and the heat from the fuser roller or belt (52) act to fix the toner onto the paper. The coating must also, therefore, be one which grips the paper as it moves through the fusing nip and one which has good release properties for the paper and the toner. Although the coating (74) is referred to as a "rubberized material", it does not have to contain a rubber component as long as it has the required transport and release properties. The rubberized material used for the coating (74) is preferably selected from rubber, silicone rubber, and mixtures thereof. A preferred material for the coating is silicone rubber, particularly one which includes a fluoropolymer (e.g., Teflon) outer coating 74*a* for its release properties. The coating 74 may be fastened onto the back-up roller in a way conventionally known in the art (e.g., friction, adhesive). The coating (74) generally has a thickness of no greater than about 5 mm, and preferably has a thickness of no greater than about 3 mm. If the coating is too thick, it tends to expand when heated in the fusing process, resulting in problems controlling the velocity of the recording medium through the fuser.

The typical (prior art) back-up roller (51) utilized in electrophotographic processes is solid, either made from solid metal with a rubberized coating on it, or from a solid rubber-type material. When the printer is switched on, and the heating element on the fuser roller or belt becomes hot, these prior art back-up rollers take a significant amount of time to warm up to a temperature approximating that of the fuser roller or belt. Because the temperature of these back-up rollers remains relatively low during this warm-up period, moisture which is formed during the fusing process tends to condense on the back-up roller surface causing fuser stalls. Because the rollers of the present invention are made from a metal having good thermal properties and contain relatively little metal and a great deal of void space, these back-up rollers (51) warm up to a temperature approximating that of the fuser roller or belt much more quickly, thereby reducing the condensation of moisture on their outer surface.

What is claimed is:

1. An image fixing device comprising:

a) a moveable heated fusing belt fixing member and a rotatable back-up member forming a nip therebetween, which transport a recording material through said nip thereby fixing toner to create an image on said recording material;

b) a ceramic heater contacting said fusing belt at said nip to heat said fusing belt for said fixing;

c) means for driving said back-up member to move said fusing belt during said fixing; and d) wherein said back-up member comprises an inner cylindrical metal core, an outer hollow cylindrical metal shell surrounding said core, and a plurality of metal ribs running lengthwise between and attached to said core and said shell, wherein the outer surface of said shell carries a layer of a rubberized material having a thickness of no greater than about 5 mm and wherein the mass of said back-up member is low whereby said back-up member heats quickly during said fusing to avoid moisture condensation on said back-up member.

2. The image-fixing device according to claim 1 wherein the ribs, inner core and outer shell of the back-up member are all made from the same metal material.

3. The image-fixing device according to claim 2 wherein the metal material is selected from the group consisting of steel, copper, aluminum, and mixtures thereof.

4. The image-fixing device according to claim 3 wherein the length of the back-up member is from about 21 to about 30 cm.

5. The image-fixing device according to claim 4 wherein the diameter of the back-up member is from about 15 to about 50 mm.

6. The image-fixing device according to claim 2 wherein the metal portions of the back-up member are formed in one piece by an extrusion process.

7. The image-fixing device according to claim 5 wherein the rubberized material on the back-up member has good release and transport properties for paper.

8. The image-fixing device according to claim 5 wherein the ribs in the back-up member are equally spaced relative to each other around the core.

9. The image-fixing device according to claim 8 wherein the back-up member contains three or four ribs.

10. The image-fixing device according to claim 9 wherein the rubberized material on the back-up member is selected from the group consisting of rubber, silicone rubber, and mixtures thereof.

11. The image-fixing device according to claim 10 wherein the rubberized material is a silicone rubber having a fluororesin coating on its surface.

12. The image-fixing device according to claim 10 wherein the metal used for fabricating the back-up member is aluminum.

13. The image-fixing device according to claim 12 wherein the rubberized material in the back-up member is silicone rubber.

14. The image-fixing device according to claim 13 wherein the back-up member contains four ribs.

15. The image-fixing device according to claim 10 wherein the thickness of the rubberized material coating on the back-up member is no greater than about 3 mm.

* * * * *